US010760248B2

(12) United States Patent
Deubler, IV et al.

(10) Patent No.: US 10,760,248 B2
(45) Date of Patent: Sep. 1, 2020

(54) HYDRANT TOOL

(71) Applicants: Richard Eugene Deubler, IV, Lima, OH (US); Miles Curtis Conrad, Lima, OH (US)

(72) Inventors: Richard Eugene Deubler, IV, Lima, OH (US); Miles Curtis Conrad, Lima, OH (US)

( * ) Notice: Subject to any disclaimer, the term of this patent is extended or adjusted under 35 U.S.C. 154(b) by 297 days.

(21) Appl. No.: 15/908,298

(22) Filed: Feb. 28, 2018

(65) Prior Publication Data

US 2018/0245319 A1 Aug. 30, 2018

Related U.S. Application Data

(60) Provisional application No. 62/600,672, filed on Feb. 28, 2017.

(51) Int. Cl.

| | |
|---|---|
| ***E03B 9/02*** | (2006.01) |
| ***B25B 13/06*** | (2006.01) |
| ***B25B 13/48*** | (2006.01) |
| ***B25B 23/16*** | (2006.01) |
| ***B25B 13/50*** | (2006.01) |

(52) U.S. Cl.
CPC ..... *E03B 9/02* (2013.01); *B25B 13/065* (2013.01); *B25B 13/48* (2013.01); *B25B 13/481* (2013.01); *B25B 13/5091* (2013.01); *B25B 23/16* (2013.01)

(58) Field of Classification Search
CPC ..... E03B 9/02; B25B 13/065; B25B 13/481; B25B 23/16; B25B 13/04; B25B 13/06; B25B 13/48; B25B 23/0071
See application file for complete search history.

(56) References Cited

U.S. PATENT DOCUMENTS 4,811,623 A * 3/1989 Tomiser, Jr. ..... G05G 1/08 74/547
6,349,622 B1 * 2/2002 Lemaire ..... B25B 13/48 251/291

* cited by examiner

*Primary Examiner* — Brian D Keller
(74) *Attorney, Agent, or Firm* — Dunlap Bennett & Ludwig, PLLC; Brendan E. Squire

(57) ABSTRACT

A hydrant tool for performing fire hydrant operations. The hydrant tool includes a wheel shaped base, a selectively extensible leverage bar that extends from a lateral edge of the wheel shaped base. A wrench opening, preferably a Storz wrench opening extends is defined in a lateral edge of the base. A center portion of the base includes a configurable socketed opening for operation of the hydrant valve.

20 Claims, 3 Drawing Sheets

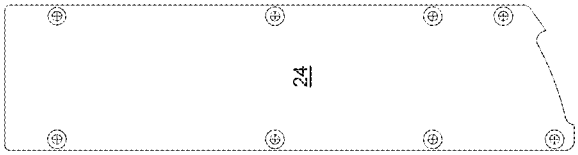
FIG. 12
FIG. 13
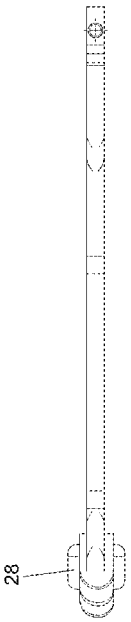
FIG. 9
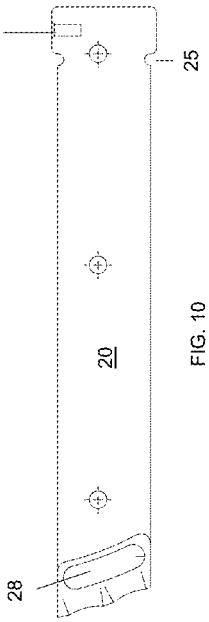
FIG. 10
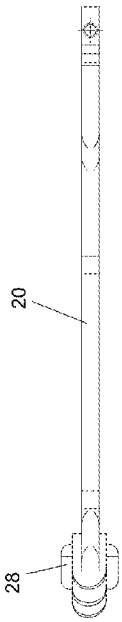
FIG. 11
FIG. 14
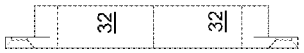
FIG. 15
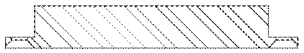
FIG. 16

HYDRANT TOOL

CROSS-REFERENCE TO RELATED APPLICATION

This application claims the benefit of priority of U.S. provisional application No. 62/600,672, filed Feb. 28, 2017, the contents of which are herein incorporated by reference.

BACKGROUND OF THE INVENTION

The present invention relates to firefighting tools, and more particularly to firefighting tools for operating a fire hydrant.

A major problem that is often experienced by fire hydrant operators/firefighters is caused by the location of the hydrant with regard to other structures in its close proximity. When hydrants are located near a buildings, fences, walls, parked vehicles, ballads, power poles or sign posts, it is not possible to fully rotate most hydrant tools/devices 360 degrees, thus impeding or slowing down the speed in which the hydrant can be opened or closed to combat a fire.

Likewise, many hydrant tools/devices are long in length and do not allow for a operator/firefighter to stand safely in one place while opening or closing a hydrant. Those type of hydrant tools; devices cause the operator/firefighter to over reach or extend their bodies when trying to stand safely in one place during hydrant operations, thus causing many back and shoulder injuries.

Using these elongated tools, the operator/firefighter must also walk around the hydrant and in front of the hydrant's discharge caps in order to open or close the hydrant. If these discharge caps are loosely or improperly applied, they can become very dangerous when the hydrant is under pressure. These loose discharge caps can violently fly off and injure the operator/firefighter that is walking around in front of them. Also, walking around a hydrant can be hazardous in times of inclement weather.

In winter conditions, when ice is concealed under the snow, a slip and fall injury can occur. When opening or closing a hydrant, standing in the safe zone is very important. This one act will dramatically reduce the number of injuries to operators/firefighters. These are only some of the most common threats to the safety of personnel while opening and closing a common fire hydrant.

As can be seen, there is a need for an tool and method for operating a fire hydrant.

SUMMARY OF THE INVENTION

In one aspect of the present invention, a hydrant operating tool includes a base wheel that is formed as a generally round plate having a plurality of finger grip protrusions around a peripheral edge of the base wheel. A Storz wrench opening is defined in a side edge of the base wheel. A leverage bar is extensible from a lateral edge of the base wheel. A socketed opening defined in a center of the base wheel, and is configured for engagement with an operating valve of the hydrant.

In some embodiments, an elongate slot is defined in a front face of the base wheel and extending through the peripheral edge of the base wheel. The leverage bar is received in and is extensible from the elongate slot. A 20 is dimensioned to cover a majority of the elongate slot and retain the leverage bar within the elongate slot.

In yet other embodiments, a detent is defined in a lateral side edge of the leverage bar and a biased pawl protrudes into the elongate slot and is configured to engage with the detent. The detent is defined at a first end of the leverage bar to retain the leverage bar in an extended position. In addition, the detent may be defined at a second end of the leverage bar to retain the leverage bar in a retracted position.

In preferred embodiments, the socketed opening comprises a plurality of geometrically shaped apertures. The socketed opening may be carried in a replaceable insert that is adapted to be received in an bore defined in the base plate.

In yet other embodiments, a plurality of hand holds are defined through a face of the base plate and disposed in a spaced apart relation about a circumference of the base plate.

These and other features, aspects and advantages of the present invention will become better understood with reference to the following drawings, description and claims.

BRIEF DESCRIPTION OF THE DRAWINGS

FIG. 9 is a top plan view of a leverage bar.

FIG. 10 is a side elevation view of the leverage bar.

FIG. 11 is a bottom plan view of the leverage bar.

FIG. 12 is a side elevation view of a cover plate.

FIG. 13 is an end elevation view of the cover plate.

FIG. 14 is a top plan view of a socket plate.

FIG. 15 is a sectional view taken along the longitudinal centerline of the socket plate shown in FIG. 14.

FIG. 16 is a sectional view of the socket plate taken along line 16-16.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved hydrant operating tool and method of operating the same. The present invention provides a solution to existing problems with hydrant tools by providing a hydrant tool that is compact and allows the operator to stand firmly and safely in one place while opening and closing a fire hydrant. This hydrant tools/device design allows for quicker and a more safe hydrant operation.

Figure 3:
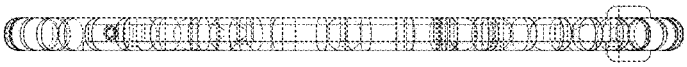
FIG. 3 is an end elevation view of the hydrant tool.
Figure 2:
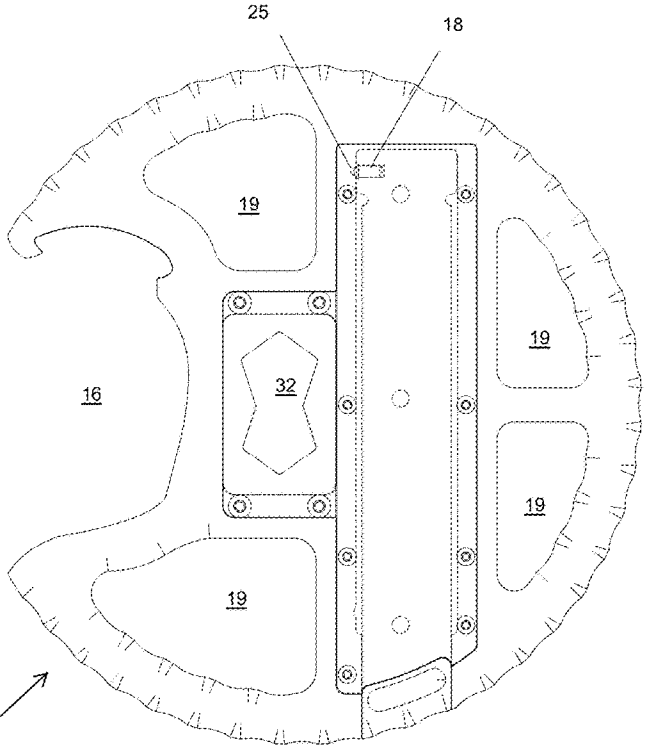
FIG. 2 is a side elevation view of the hydrant tool shown in a stowed position.
Figure 1:
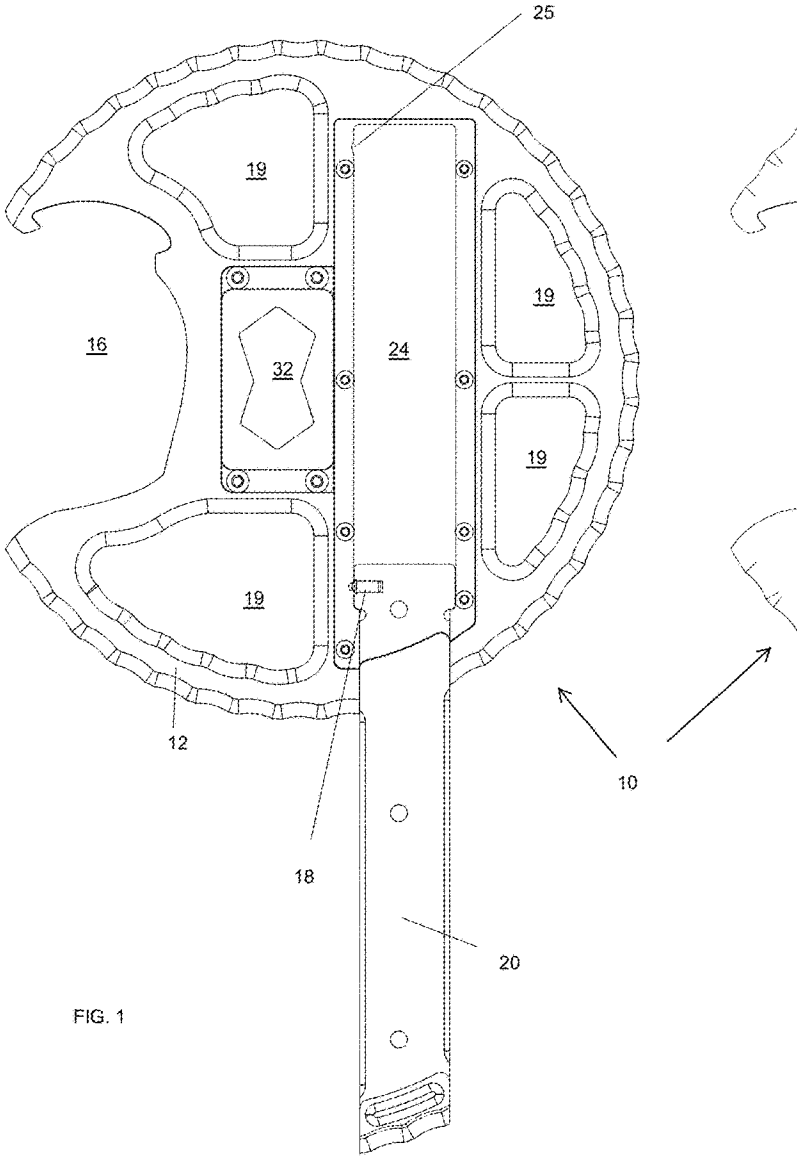
FIG. 1 is a side elevation view of an embodiment of a hydrant tool shown in an extended position.
Figure 8:
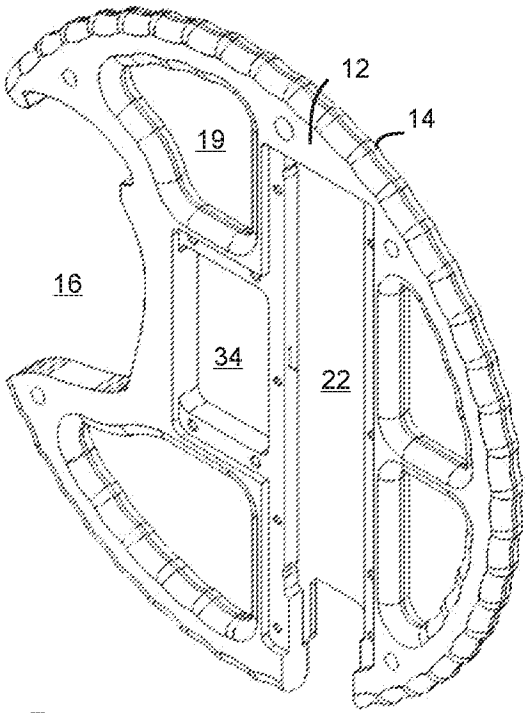
FIG. 8 is a perspective view of a 3D rendering of the base wheel.
Figure 7:
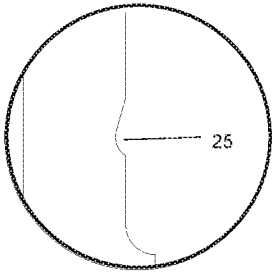
FIG. 7 is a detail view of the detent taken from circle 7 of FIG. 4.
Figure 6:
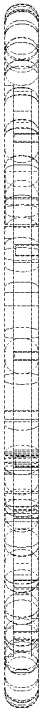
FIG. 6 is an end elevation view of the base wheel.
Figure 4:
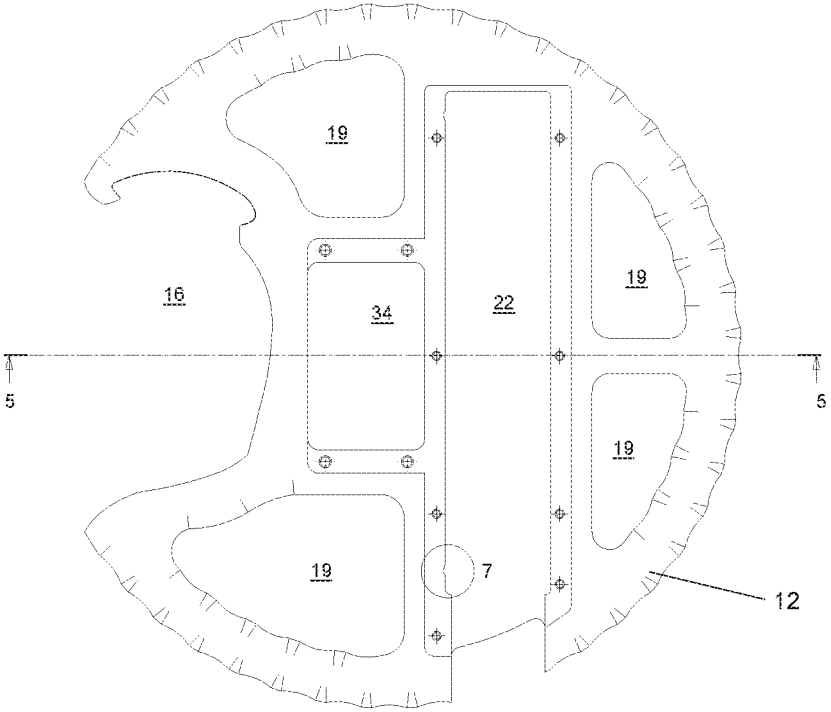
FIG. 4 is a side elevation view of a base wheel of the hydrant tool.
Figure 5:
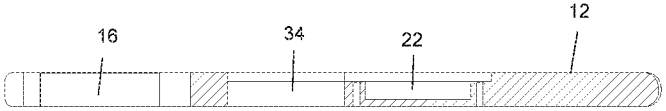
FIG. 5 is a side sectional view of the base wheel taken along line 5-5 of FIG. 4.

As seen in reference to the drawings of FIGS. 1-16, the hydrant tool 10 includes a base wheel 12 and a leverage bar 20 that is selectively extendable from a lateral side edge of the base wheel 12. The base wheel 12 may be formed to a comfortable 15 inch circumference wheel with a plurality of finger grip protrusions 14 defined around a peripheral edge of the base wheel 12. The tool components may be made from a lightweight and durable material. A center of hydrant tool is made to hold an interchangeable socket 32 that can be customized to fit any hydrant operating valve.

A wrench opening 16 is defined in a side edge of the base wheel 12. Preferably, the wrench opening is a Storz wrench opening 16 that is configured for engagement with and removal of a Storz type cap from a fire hydrant. A plurality of hand holds 19 are preferably defined through a face of the base plate and disposed in a spaced apart relation about a circumference of the base plate 12. The hand holds 19 provide for a better gripping action by the fire fighter and contribute to reducing the weight of the hydrant tool 12.

The leverage bar 20 is selectively extensible from a lateral edge of the base wheel 12. The base wheel 12 may be configured with an elongate slot 22 that is defined in a front face of the base wheel 12 and extends through the peripheral edge of the base wheel 12. The leverage bar 20 is captively received in and extensible from the elongate slot 22. A cover plate 24 may be provided and is dimensioned to cover a majority of the elongate slot 22 and retain the leverage bar 20 within the elongate slot 22. The cover plate 24 may be secured to the base wheel 12 by a plurality of fasteners.

The leverage bar 20 may also include one or more detents 25 defined in a lateral side edge of the leverage bar. A biased pawl 18 may be received within a bias aperture in the elongate slot 22. The biased pawl 18 protrudes into the elongate slot 22 and is configured for cooperative engage with the detent 25. The one or more detents 25 may be defined at a first end of the leverage bar 20 to retain the leverage bar 20 in an extended position. The detent 25 may also be defined at a second end of the leverage bar 20 to retain the leverage bar 20 in a retracted position. Alternatively, the detents 25 and pawl 18 may be reversed such that the detents 25 are defined in the elongate slot 22 and the pawl 18 is defined in the leverage bar 20.

The leverage bar 20 can easily be extended by pulling on a raised protrusion grip 28 at the second end of the leverage bar 20. This raised extension grip allows the leverage bar 20 to be extended with gloved hands, as would typically be the case for a firefighter wearing personal protective gear.

The socketed opening 32 is preferably defined near a center of the base wheel 12 and is configured for cooperative engagement with an operating valve of the hydrant. The socketed opening 32 may comprises a plurality of geometrically shaped apertures 32, such as a square, a pentagon, a hexagon, and the like that is compatible with the operating valve of the hydrant. The plurality of socketed openings 32 may be the same geometric shape, with a first shape dimensioned to fit the operating valve nut. The second of the plurality of socketed openings 32 may be dimensioned larger than the operating valve nut to accommodate for the presence of additional layers of paint, corrosion, and other contaminants, that may have been applied to or developed on the hydrant after being placed in service.

In a preferred embodiment, the socketed opening 32 includes a replaceable insert 30, adapted to be received in a slotted bore 34 defined in the base plate 12. The replaceable insert 30 is made from a hardened material that can withstand wear and tear during normal use. The replaceable insert 30 may be secured to the base wheel 12 via a plurality of fasteners.

As will be appreciated, the hydrant tool 10 of the present invention is configured to facilitate safe and efficient hydrant operations. The hydrant tool 10 permits the operator/firefighter the ability to remove all common hydrant caps, including the Storz style coupling. The replaceable socketed insert 30 provides the ability to select a socketed opening 32 that may be used on any hydrant manufactured world wide. This customizable socketed insert 30 can be removed and replaced at any time by the consumer or from the manufacturer at time of purchase.

It should be understood, of course, that the foregoing relates to exemplary embodiments of the invention and that modifications may be made without departing from the spirit and scope of the invention as set forth in the following claims.

What is claimed is:

1. A hydrant operating tool, comprising:

a base wheel formed as a generally round plate having a plurality of finger grip protrusions around a peripheral edge of the base wheel;

an elongate slot defined in a front face of the base wheel and extending through the peripheral edge of the base wheel;

a wrench opening defined in a side edge of the base wheel;

a leverage bar selectively extensible from the peripheral edge of the base wheel and slidably operable along the elongate slot between a stowed position and an operating position; and a socketed opening defined in a center of the base wheel, configured for engagement with an operating valve of the hydrant.

2. The hydrant operating tool of claim 1, further comprising:

the elongate slot defined in the front face of the base wheel and extends through the peripheral edge of the base wheel.

3. The hydrant operating tool of claim 2, further comprising:

a detent defined in a lateral side edge of the leverage bar; and a biased pawl protruding into the elongate slot configured to engage with the detent.

4. The hydrant operating tool of claim 3, wherein the detent is defined at a first end of the leverage bar to retain the leverage bar in an extended position.

5. The hydrant operating tool of claim 3, where the detent is defined at a second end of the leverage bar to retain the leverage bar in a retracted position.

6. The hydrant operating tool of claim 2, further comprising:

a detent defined in a lateral side edge of the elongate slot; and a biased pawl protruding from the leverage bar configured to engage with the detent.

7. The hydrant operating tool of claim 6, wherein the detent is defined at a first end of the elongate slot to retain the leverage bar in an extended position.

8. The hydrant operating tool of claim 7, where the detent is defined at a second end of the elongate slot to retain the leverage bar in a retracted position.

9. The hydrant operating tool of claim 1, further comprising;

a cover plate dimensioned to cover a majority of the elongate slot and retain the leverage bar within the elongate slot.

10. The hydrant operating tool of claim 1, wherein the socketed opening comprises a plurality of geometrically shaped apertures.

11. The hydrant operating tool of claim 1, wherein the socketed opening comprises a replaceable insert adapted to be received in a bore defined in the base wheel.

12. The hydrant operating tool of claim 1, further comprising:

a plurality of hand holds defined through the front face of the base wheel and disposed in a spaced apart relation about a circumference of the base wheel.

13. The hydrant operating tool of claim 1, wherein the wrench opening is configured to operate a Storz hydrant fitting.

14. The hydrant operating tool of claim 13, further comprising:

a plurality of hand holds defined through the front face of the base wheel and disposed in a spaced apart relation about a circumference of the base wheel.

15. A valve operating tool, comprising:

a base wheel formed as a generally round plate having an elongate slot defined in a front face of the base wheel and extending through a peripheral edge of the base wheel;

a leverage bar laterally extensible between a stowed position and an extended position, wherein in the stowed position a majority of the leverage bar is received in the elongate slot and in the extended position a minority of the leverage bar is received in the elongate slot where the majority of the leverage bar extends beyond the peripheral edge of the base wheel;

a cover plate covering the elongate slot to retain the leverage bar within the elongate slot; and a socketed opening defined in a center of the base wheel configured for engagement with an operating valve.

16. The hydrant operating tool of claim 15, further comprising:

a cooperating pawl and detent are disposed between the elongate slot and the leverage bar to retain the leverage bar in at least one of the stowed position and the extended position.

17. The hydrant operating tool of claim 15, wherein the socketed opening comprises a plurality of geometrically shaped apertures.

18. The hydrant operating tool of claim 15, wherein the socketed opening comprises a replaceable insert adapted to be received in a bore defined in the base wheel.

19. The hydrant operating tool of claim 15, further comprising:

a plurality of hand holds defined through the front face of the base wheel and disposed in a spaced apart relation about a circumference of the base wheel.

20. A valve operating tool, comprising:

a base wheel formed as a generally round plate, a plurality of scalloped finger protrusions defined in a spaced apart relation around a circumferential edge of the base wheel;

an elongate slot defined in a face the base wheel, the elongate slot having an opening to the circumferential edge;

a leverage bar laterally slidably extensible within the slot between a stowed position and an operating position;

a replaceable insert configured to fit a hydrant operating valve is carried in a center of the base wheel; and a cooperating detent and a biased pawl disposed to releasably retain the leverage bar in at least one of the operating position and the stowed position.

* * * * *